US005161374A

United States Patent [19]

Schiessl

[11] Patent Number: 5,161,374

[45] Date of Patent: Nov. 10, 1992

[54] HOT GAS ENGINE WITH TUBULAR RADIAL FLOW REGENERATORS

[75] Inventor: Gerhard Schiessl, Augsburg, Fed. Rep. of Germany

[73] Assignee: Man Technologie Aktiengesellschaft

[21] Appl. No.: 742,309

[22] Filed: Aug. 8, 1991

[51] Int. Cl.[5] ..... F02G 1/57

[52] U.S. Cl. ..... 60/526

[58] Field of Search ..... 60/517, 526

[56] References Cited

U.S. PATENT DOCUMENTS 3,320,044 5/1967 Cole et al. ..... 165/4 X 4,532,765 8/1985 Corey ..... 60/526

OTHER PUBLICATIONS

Automotive Stirling Engine Development Program; Quarterly Technical Progress Report for Period: Jul. 1-Sep. 30, 1979.

*Primary Examiner*—Allen M. Ostrager

[57] ABSTRACT

In a hot gas or Stirling engine conventional regenerators for engines with a large displacement, designed for axially directed flow and usually lacking sufficient mechanical strength with respect to the high working gas pressures, have been replaced by radial flow regenerators. In the respective receiving spaces, the radial flow regenerators are surrounded externally and internally by an annular duct for the supply and discharge of the working gas. Thus, it is possible to ensure a larger flow area for the working gas and to design the engine with the desired mechanical strength.

11 Claims, 4 Drawing Sheets

HOT GAS ENGINE WITH TUBULAR RADIAL FLOW REGENERATORS

BACKGROUND OF THE INVENTION

The invention relates to a hot gas or Stirling engine whose cylinder chambers are connected via heating tubes, which extend through a heating chamber, with regenerator-cooler units.

In the case of hot gas or Stirling engines whose cylinder chambers are connected via heating tubes, which extend through a heating chamber, with regenerator-cooler units, the regenerators have been generally limited to the axial flow type. In this respect, dependent on the design of the engine, a distinction has been made between cylindrical regenerators, which are respectively housed together with a separate cooler, that is disposed axially to the rear thereof, in their own housings arranged adjacent to the associated cylinders, on the one hand, and, on the other hand, annular cylindrical regenerators, which are respectively accommodated together with coolers, which are also annular cylindrical and are arranged thereunder, coaxially to the respectively associated cylinders in the engine housing. These two principles of design are illustrated together in FIG. 3.5.2-6 on page 112 of the publication DOE/-NASA/0032-79/5, NASA CR-159744, MTI 79 ASE 101QT6, entitled "Automotive Stirling Engine Development Program" quarterly technical progress report for period July 1–Sept. 30, 1979, Mechanical Technology Incorporated, January 1980. The key feature of the two designs is that the respective regenerator is precisely fitted as a prefabricated unit in a receiving space the configuration and diameter of which are adapted to the dimensions of the regenerator. Furthermore, whatever its particular design, the regenerator is such that the working gas is only able to enter and leave via its ends and is only able to flow axially through it. The ultimate flow area available for the working gas was for this reason limited by the diameter of the receiving space for the regenerator.

Thus, especially in the case of hot gas or Stirling engines with a large displacement and with regenerators which, hence, have to be large as well, the relatively high working gas pressure of approximately 160 bar leads to mechanical strength problems in the regenerator housing and the engine housing, respectively. These problems have so far only been dealt with by having regenerator housings or engine housing which are either manufactured of materials with a greater resistance to pressure or with suitably thicker walls. Both features, however, ultimately led to a substantial increase in the price of the engine. In the case of annular cylindrical regenerators arranged coaxially to the cylinders any increase in the thickness of the walls in the engine housing led furthermore to an increase in the distance between the cylinders and consequently to an increase in the length of the engine, which was not desired.

Accordingly, it is an object of the present invention to provide a systematic modification of the regenerators so that the above mentioned disadvantageous features may be avoided in the case of engines with a large displacement and with high working gas pressures.

SUMMARY OF THE PRESENT INVENTION

The hot gas engine of the present invention is primarily characterized by an engine housing with receiving spaces; means defining cylinder chambers within the engine housing; regenerator-cooler units each comprising a tubular regenerator that is designed for radial flow of a working gas, whereby the regenerator is disposed within a respective one of the receiving spaces, and a cooler having a cooler housing; heating tubes connecting the cylinder chambers to the regenerator-cooler units; an outer annular duct defined outside each one of the regenerators, and an inner annular duct inside each one of the regenerators for supplying and discharging a working gas, whereby the outer and inner annular ducts are communicating with one another, and the outer annular duct communicates with the heating tubes.

In other words, tubular regenerators are employed, whereby each one is designed for radial flow and is disposed in the respective receiving space, and is surrounded by annular ducts serving as the inlet and outlet of the working gas both on its inside and on its outside.

In comparison with known regenerators of about the same size but with axial flow, this radial flow design and arrangement of the regenerators is responsible for a considerable increase in the flow area of the regenerator which in turn leads to a very great advantage for the Stirling process, since the internal flow losses are reduced, and accordingly there is an increase in the efficiency of the engine.

The selection of the size of the flow area will depend on the desired overall length of the tubular regenerator, and can easily be determined. The diameter of the regenerator will still be comparatively small and strength problems may be taken care of by the use of conventional means.

In a further embodiment, the regenerator is a thick-walled tube with an inner wall surface, an outer wall surface and a matrix of the tube being penetrable in a radial direction by a working gas whereby the working gas, when radially flowing from a hot expansion side of the hot gas engine to a cold compression side of the hot gas engine, transfers heat to the regenerator and, when flowing from the cold compression side of the engine to the hot expansion side of the hot gas engine, removes heat from the regenerator. The matrix of the tube may consist of knitted or woven thin wires wound to a tubular shape, of porous sintered ceramic materials or of foamed porous materials. It is also possible to have a mixture of randomly arranged fibers for the use as a matrix. Also, the matrix may consist of particles.

It is preferable, that the regenerator be provided with a heat shield at one end thereof that is facing the heating tubes.

In a further embodiment at least one of the regenerator-cooler units is incorporated in a separate housing provided within said engine housing; the respective regenerator-cooler unit further comprising: a fastening means comprising an outer annular support having a outer configuration corresponding to the further receiving space and having a radially inwardly extending support ring for supporting the regenerator thereon; a heat shield at an end of the outer annular support opposite the support ring; a core bolt extending in an axial direction of the outer annular support from the heat shield to the support ring and at an end adjacent to the support ring being provided with elastic intermediate sheets; and a tie rod disposed in a through bore of the core bolt for fastening the outer annular support, the heat shield and the core bolt to the cooler housing; whereby a radial space between the regenerator and the outer annular support respectively a further radial space between the regenerator and the core bolt define the outer and inner annular ducts.

In another preferred embodiment at least one of the receiving spaces is in the form of an annular passage coaxial to the cylinder chambers within the engine housing and is connected to the cooler, whereby the regenerator is disposed in the receiving space; the regenerator further comprises a terminating plate at one end thereof with which the regenerators are connected to the cooler, whereby the terminating plate has through holes for connecting the inner annular duct to a reservoir of the cooler and with tubes of the cooler for transporting a working gas communicating with the reservoir; and a heat shield disposed at an end opposite the terminating plate for radially and axially adjusting the regenerator in the receiving space.

BRIEF DESCRIPTION OF THE DRAWINGS

The present invention will now be described in more detail with reference to the accompanying drawings, in which.

DESCRIPTION OF PREFERRED EMBODIMENTS

The present invention will now be described in detail with the aid of several specific embodiments utilizing FIGS. 1 through 4.

Figure 1:
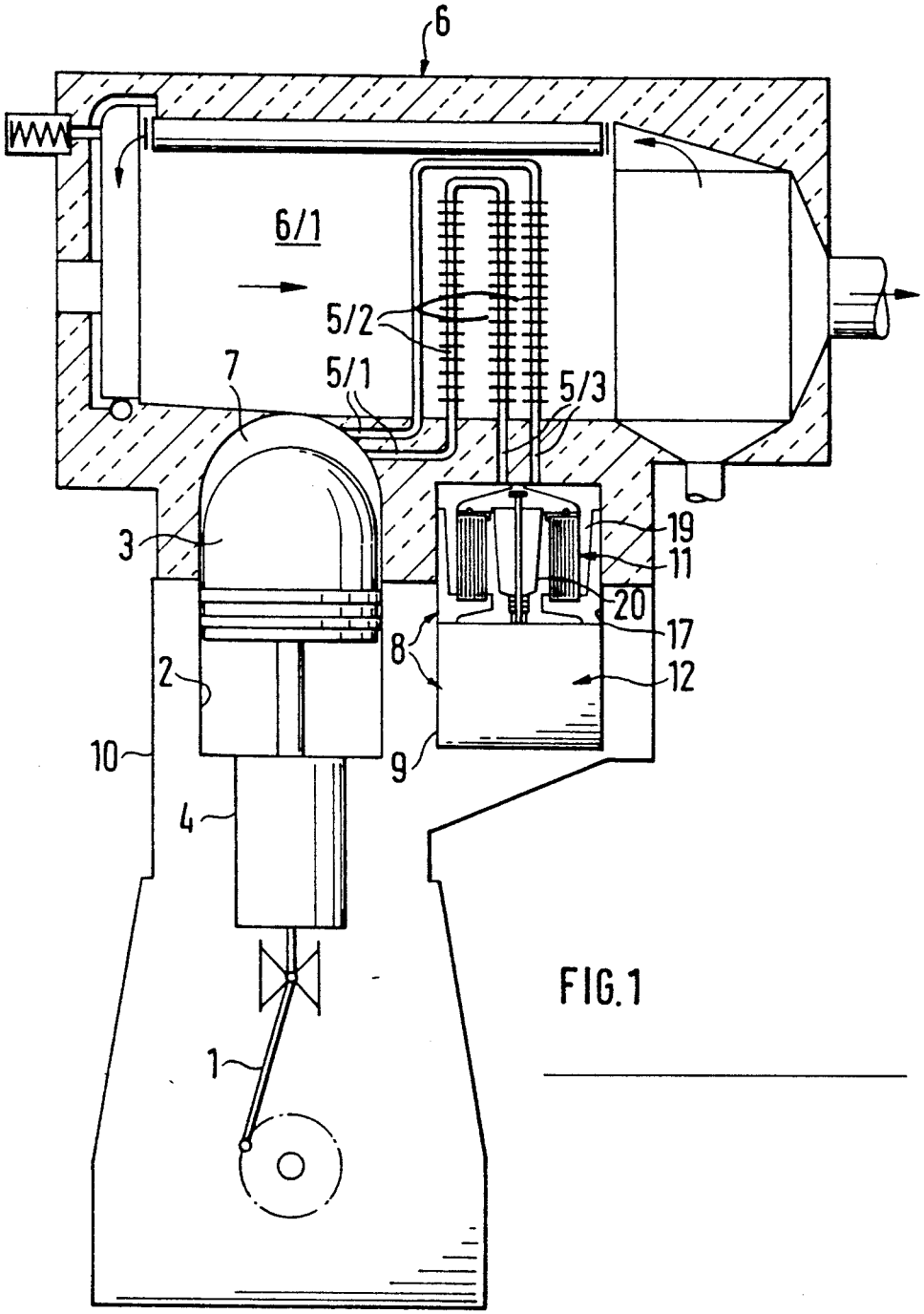
FIG. 1 shows a cross section of a diagrammatically illustrated hot gas or Stirling engine with a regenerator-cooler unit which is arranged in its own housing adjacent to one cylinder.
Figure 3:
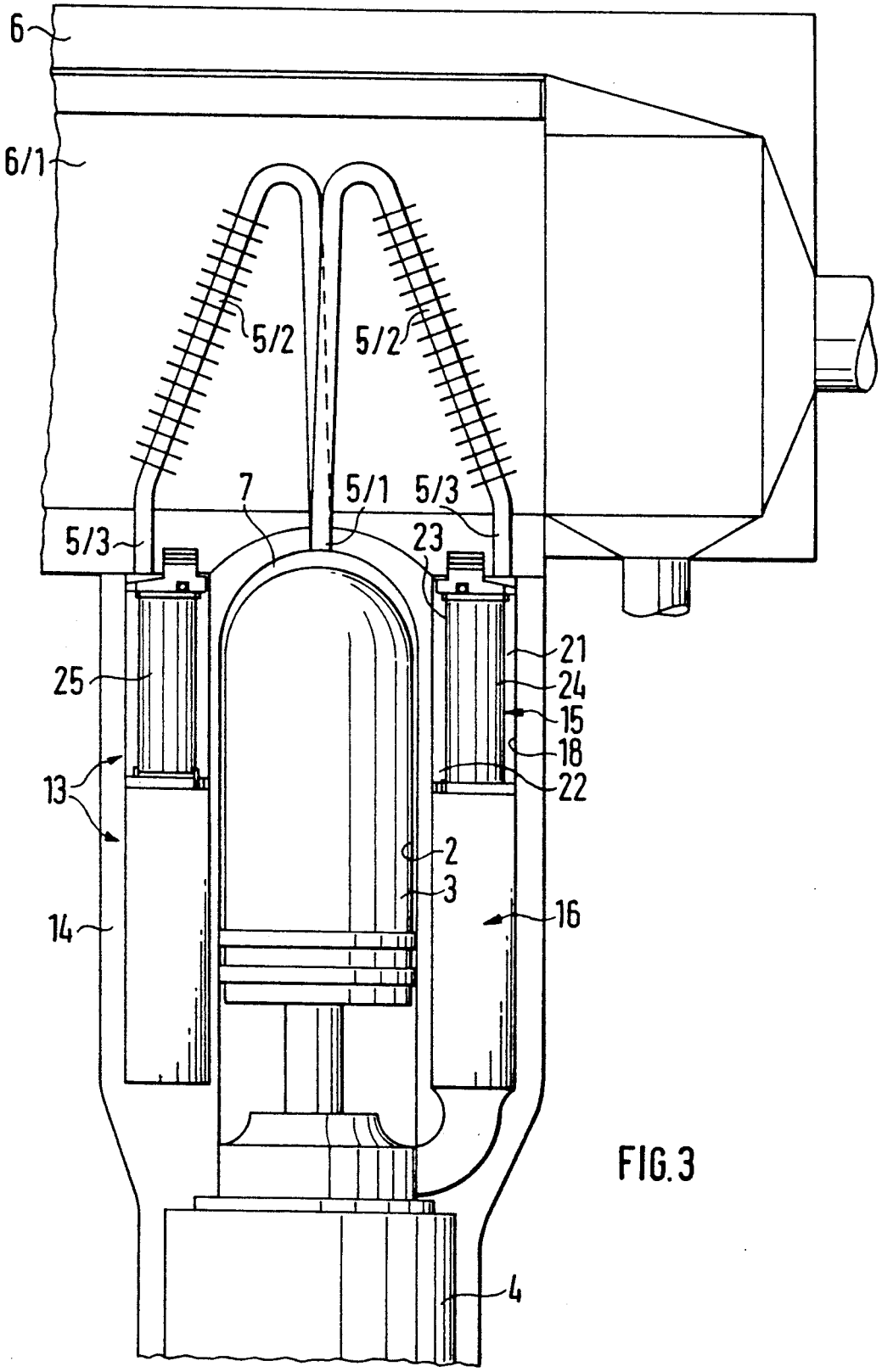
FIG. 3 shows a cross-section of another embodiment of a Stirling engine which is also shown diagrammatically and represents a modification of the design illustrated in FIG. 1 and has a regenerator-cooler unit arranged coaxially to one of the cylinders.

The hot gas or Stirling engines illustrated in FIGS. 1 and 3 have a conventional design with respect to the configuration and arrangement of the connecting rod system 1, the cylinders 2 with the pistons 3 therein, the piston rod seals 4, the ducts 5 for the working gas (that is to say the heating tubes and the connection ducts) and the heating system 6. In order to understand the invention it is only necessary to consider the regenerator-cooler units which will be described in more detail in the following paragraphs.

In the case of the hot gas or Stirling engine illustrated in FIG. 1 the cylinder chambers 7 are respectively connected via connection ducts 5/1 inside the cylinder heads, heating tubes 5/2 which are connected therewith and lead through a heating chamber 6/1, and transfer ducts 5/3 with a regenerator-cooler unit 8 which is arranged in a receiving space 17 of a separate housing 9 arranged adjacent to one cylinder 2. The regenerator-cooler unit housing 9 is secured to the engine housing 10 in a known manner which is not illustrated, such engine housing furthermore being of conventional design in other respects. Each regenerator-cooler unit 8 in this case consists of a regenerator 11 and a cooler 12 arranged underneath the regenerator 11.

The hot gas or Stirling engine illustrated in FIG. 3 deviates from the previous design since its cylinder chambers 7 are respectively connected via connection ducts 5/1 and heating tubes 5/2, which are jointed to the connection ducts 5/1 and lead through a heating chamber 6/1, and via transfer ducts 5/3 inside the cylinders with a regenerator-cooler unit 13, which is (a) coaxially outwardly arranged relative to a cylinder 2 in a receiving space 18 in the engine housing 14 which is suitably adapted and (b) consists of a regenerator 15 and of a cooler 16 which adjoins the lower part of the regenerator.

Whatever the type of engine provided, in accordance with the invention, tubular regenerators 11 (FIGS. 1 and 2) or, respectively, 15 (FIGS. 3 and 4) are utilized, which are designed for radial flow of the working gas, for instance helium, and with which in the respective receiving space 17 in the regenerator cooler unit housing 9 and, respectively, 18 in the engine housing 14 a respective inner and outer annular duct 19 and 20 (FIGS. 1 and 2) or respectively 21 and 22 (FIGS. 3 and 4) is associated that serve for the radial inlet and outlet flow of the working gas.

Basically each regenerator 11 and 15 consists of a thick-walled tube, whose inner wall surface 23 and whose outer wall surface 24 and furthermore the matrix or openwork array of the tube 25 allows the passage of the working gas in a radial direction. In this respect the working gas flowing from the hot expansion side of the engine into the receiving space 17 and, respectively, 18 and via the outer annular duct 19 and, respectively, 21 transfers its energy to the tube wall 23, 24 and 25 as it flows through it to the cold compression side of the engine. This energy is removed again by the working gas when flowing from the cold compression side of the engine by the cooler 12 and, respectively, 16 and through the inner annular ducts 20 and, respectively, 22 through the tube wall 23, 24 and 25 in the opposite direction.

The matrix or openwork of the tube wall 25 of the regenerator 11 and 15 may be manufactured of any suitable material in any suitable way for an acceptable resistance to flow, as for instance in the form of knitted or woven tubes, of porous sintered ceramic, or a porous foam material or indeed of a random fiber material or of particles.

Figure 2:
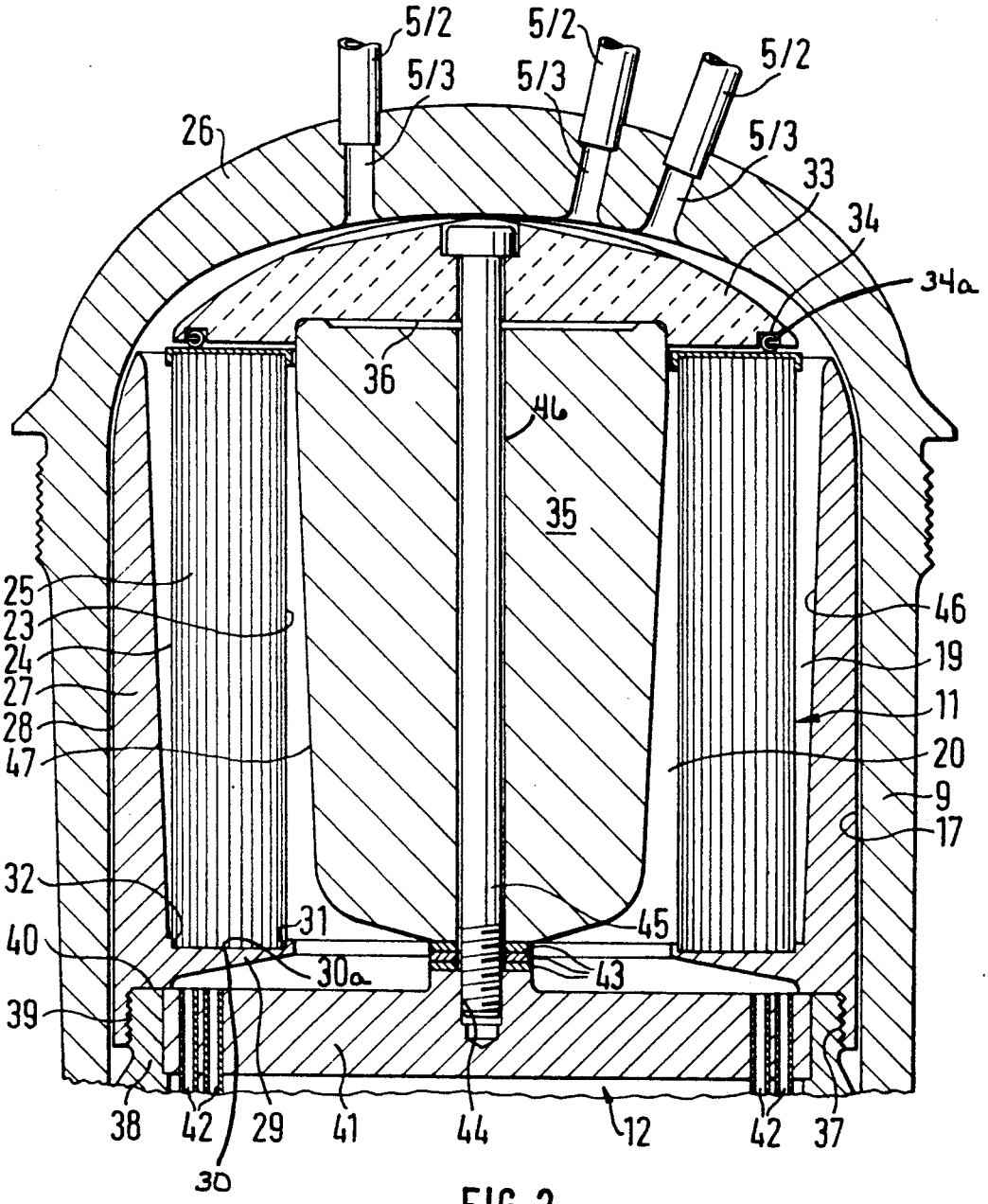
FIG. 2 shows the regenerator of FIG. 1 in more detail and on a larger scale.

In FIG. 2 an embodiment of the invention in the form of a regenerator 11 as in the engine in the accordance with FIG. 1 will be described in detail.

The heating tubes 5/2 are connected to the domed head 26 of the regenerator-cooler unit housing 9 and, via adjoining transfer ducts formed in the head 26, they communicate with the receiving space 17 of the housing 9 for the supply and removal of the working gas. Within the housing 9 the tubular regenerator 11 is received in a fastening means with which the regenerator is held in the correct position within the receiving space 17 on the cooler positioned underneath. The cooler is fastened to the housing 9 in a known manner not illustrated in detail. The device consists of an outer annular support 27 whose radially outward configuration and cross section (at 28) correspond to the receiving space 17 having a support ring 29 projecting radially inwardly at the lower end of the outer annular support 27. The support ring 29 has a circumferential groove 30 in its upper surface. The surface 30*a* of the groove supports the lower end of the regenerator 11 and the inner and outer edges 31 and 32 of the groove 30 serve to exactly position the regenerator 11 radially within the support 27. Furthermore, the fastening means consists of a plate-like heat shield 33 which, by means of a gasket ring 34 inserted in an annular groove 34*a*, bears sealingly on the upper end surface of the regenerator 11. Moreover, the fastening means has a core bolt 35 which at least partly extends longitudinally through the interior space of the regenerator 11. The bolt 35 is axially and radially fixed in a recess 36 of the heat shield 33. In the illustrated working embodiment the support 27 is screwed with a female thread 37, provided at its lower end, onto a male thread 39 provided at the upper end of the cooler housing 38 and it is pulled against the upper end surface 40 of the cooler housing 38. The cooler housing 38 is delimited at the top by a wall 41 in which tubes 42 for the working gas to be fed to the cooler 12 are mounted. This wall 41, which is fixedly connected to the cooler housing 38, constitutes an abutment, whose central blind hole thread 44 has a tie rod 45 screwed into it. The tie rod 45 functions to clamp the regenerator 11 via the heat shield 33 against the support 27 and to clamp the core bolt 35 via elastic intermediate sheets 43, which function as spacer elements, against the heat shield.

The radial space between the regenerator 11 and the internal surface 46 of the support 27 on the one hand and between the regenerator 11 and the outer surface 47 of the core bolt 35 on the other hand defines the outer and inner annular ducts 19 and 20. The annular ducts serve to supply and discharge the working gas to and from the radially outer and inner side of the regenerator 11.

Figure 4:
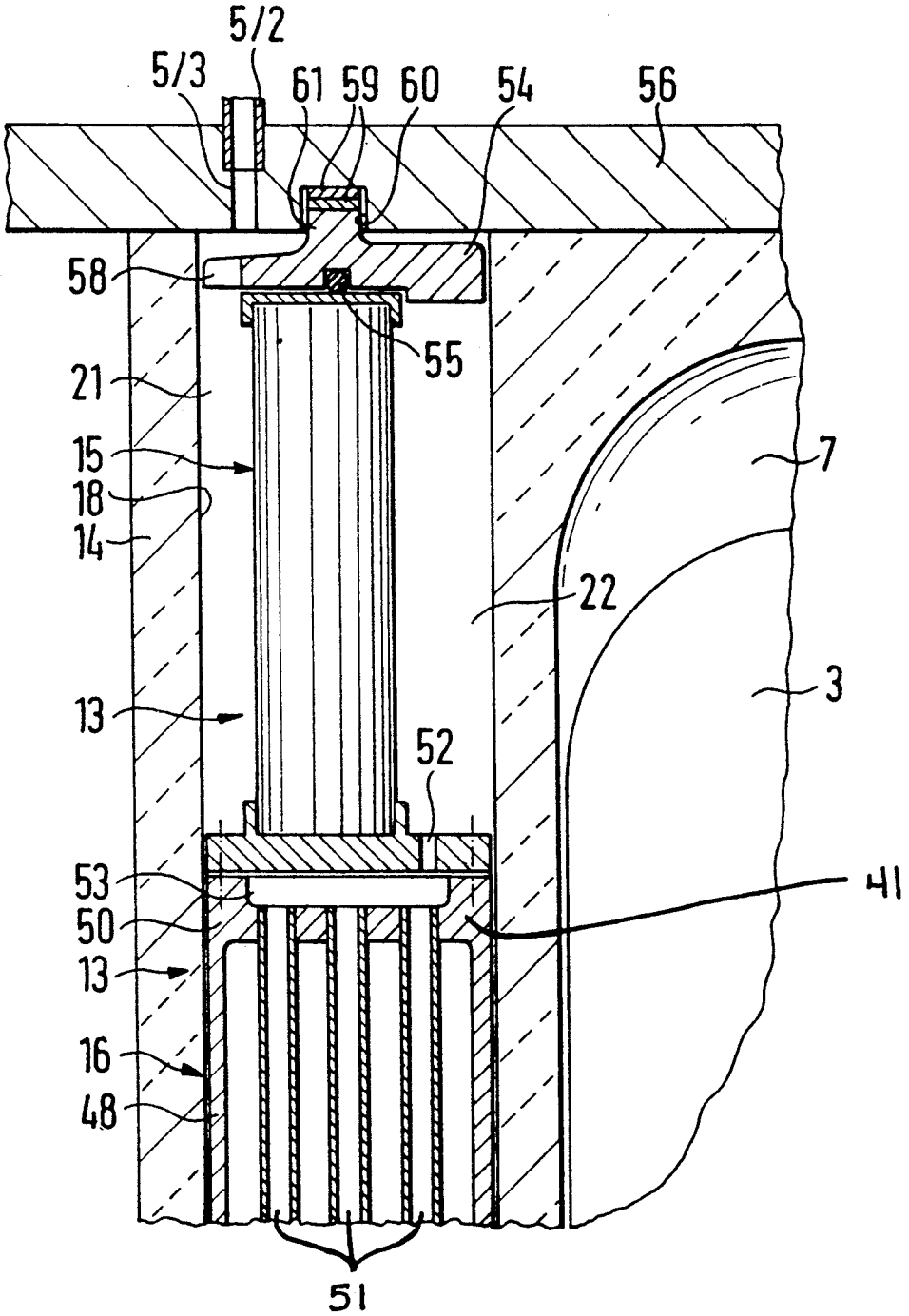
FIG. 4 shows a more detailed view of FIG. 3 on a larger scale.

In the working embodiment illustrated in FIGS. 3 and 4, the regenerator-cooler unit 13 is inserted in a cavity which is defined by an annular passage extending coaxially to the cylinder 2 in the engine housing 14 and constituting the receiving space 18, whereby the cooler 16 is mounted at the bottom of the passage 18. In this case the tubular regenerator 15 is—as illustrated in FIG. 4—attached to the upper end of the annular housing 48 of the cooler 16. For this purpose the lower termination of the regenerator 15 is in the form of a terminating plate 41, which is screwed to the upper wall 50 of the cooler 16 in which the tubes 51 for the working gas are mounted and which has through holes 52, to provide a connection between the inner annular duct 22 and a reservoir 53 in the wall 50 as a port for the working gas. At the top the regenerator 15 is radially and axially positioned by an annular heat shield 54. A gasket ring 55 prevents transfer of the working gas from the outer annular duct 21 to the inner annular duct 22. In order to allow a flow of the working gas between the transfer ducts 5/3, provided in the cylinder head 56 and communicating with the heating tubes 5/2, and the outer annular duct 21 about the regenerator 15, suitable recesses 58 are provided in the heat shield 54. The axial positioning of the regenerator-cooler unit 13, 15 and 16 is achieved by elastic thrust rings 59, which simultaneously function as gasket elements and which in an annular groove 60 of the cylinder head 56 act on a thrust ring 61 which is present at the top of the heat shield 54 and extends into the groove 60.

The present invention is, of course, in no way restricted to the specific disclosure of the specification and drawings, but also encompasses any modifications within the scope of the appended claims.

What I claim is:

1. A hot gas engine, comprising:

an engine housing with receiving spaces;

means defining cylinder chambers within said engine housing;

regenerator-cooler units each comprising a tubular regenerator that is designed for radial flow of a working gas, said regenerator disposed within a respective one of said receiving spaces, and a cooler having a cooler housing;

heating tubes connecting said cylinder chambers to said regenerator-cooler units;

an outer annular duct defined outside each one of said regenerators, and an inner annular duct inside each one of said regenerators for supplying and discharging a working gas, said outer and inner annular ducts communicating via said regenerator with one another, and said outer annular duct communicating with said heating tubes.

2. A hot gas engine according to claim 1, wherein said regenerator is a thick-walled tube, with an inner wall surface, an outer wall surface and a matrix of said tube being penetrable in a radial direction by a working gas, whereby a working gas, when radially flowing from a hot expansion side of said hot gas engine to a cold compression side of said hot gas engine, transfers heat to said regenerator and, when flowing from said cold compression side of said engine to said hot expansion side of said hot gas engine, removes heat from said regenerator.

3. A hot gas engine according to claim 2, wherein said matrix consists of knitted thin wires wound to a tubular shape.

4. A hot gas engine according to claim 2, wherein said matrix consists of woven thin wires wound to a tubular shape.

5. A hot gas engine according to claim 2, wherein said matrix consists of porous sintered ceramic material.

6. A hot gas engine according to claim 2, wherein the matrix consists of foamed porous material.

7. A hot gas engine according to claim 2, wherein the matrix consists of a mixture of randomly arranged fibers.

8. A hot gas engine according to claim 2, wherein the matrix consists of particles.

9. A hot gas engine according to claim 1, wherein said regenerator, at an end thereof facing said heating tubes, is provided with a heat shield.

10. A hot gas engine according to claim 1, wherein:

at least one of said regenerator-cooler units is incorporated in a separate housing provided within said engine housing;

said at least one regenerator-cooler units further comprises:

a fastening means comprising an outer annular support having an outer configuration corresponding to said further receiving space and having a radially inwardly extending support ring for supporting said regenerator thereon;

a heat shield at an end of said outer annular support opposite said support ring:

a core bolt extending in an axial direction of said outer annular support from said heat shield to said support ring and at an end adjacent to said support ring being provided with elastic intermediate sheets;

a tie rod disposed in a through bore of said core bolt for fastening said outer annular support, said heat shield and said core bolt to said cooler housing; whereby a radial space between said regenerator and said outer annular support respectively a further radial space between said regenerator and said core bolt define said outer and inner annular ducts.

11. A hot gas engine according to claim 1, wherein:

at least one of said receiving spaces is in the form of an annular passage coaxial to said cylinder chambers within said engine housing and is connected to said cooler, whereby said regenerator is disposed in said receiving space; and said regenerator further comprises:

a terminating plate at one end thereof with which said regenerator is connected to said cooler, said terminating plate having through holes for connecting said inner annular duct to a reservoir of said cooler, with tubes of said cooler, for transporting a working gas, communicating with said reservoir;

a heat shield, disposed at an end opposite said terminating plate, for radially and axially adjusting said regenerator in said receiving space.

* * * * *

UNITED STATES PATENT AND TRADEMARK OFFICE

CERTIFICATE OF CORRECTION

PATENT NO. : 5,161,374

DATED : Nov. 10, 1992

INVENTOR(S) : Schiessl

It is certified that error appears in the above-identified patent and that said Letters Patent is hereby corrected as shown below:

On the title page:

[73] Assignee: MAN Technologie Aktiengesellschaft, Dachauer Strasse 667, 8000 München 50, Fed. Rep. of Germany

[30] Foreign Application Priority Data

Aug. 11, 1990 [DE] Fed. Rep. of Germany ... 4025581

Signed and Sealed this

Twenty-third Day of November, 1993

*Attest:*

*Attesting Officer*

Bruce Lehman

BRUCE LEHMAN

*Commissioner of Patents and Trademarks*